United States Patent [19]

Chu

[11] Patent Number: 4,638,858

[45] Date of Patent: Jan. 27, 1987

[54] COMPOSITE HEAT TRANSFER DEVICE WITH PINS HAVING WINGS ALTERNATELY ORIENTED FOR UP-DOWN FLOW

[75] Inventor: Richard C. Chu, Poughkeepsie, N.Y.

[73] Assignee: International Business Machines Corp., Armonk, N.Y.

[21] Appl. No.: 787,868

[22] Filed: Oct. 16, 1985

[51] Int. Cl.[4] ..... F28F 7/00

[52] U.S. Cl. ..... 165/185; 165/181

[58] Field of Search ..... 165/181, 185

[56] References Cited

U.S. PATENT DOCUMENTS 4,356,864 11/1982 Ariga et al. ..... 165/185 X
4,542,784 9/1985 Welsh ..... 165/185 X
4,567,505 1/1986 Pease et al. ..... 165/185 X

FOREIGN PATENT DOCUMENTS 661230 5/1979 U.S.S.R. ..... 165/185

OTHER PUBLICATIONS

IBM Technical Disclosure Bulletin, R. C. Chu & U. P. Hwang, vol. 17, No. 12, May 1975, p. 3656.

*Primary Examiner*—Albert W. Davis, Jr.
*Assistant Examiner*—Peggy A. Neils
*Attorney, Agent, or Firm*—W. S. Robertson

[57] ABSTRACT

Heat conducting pins are mounted on a base to be cooled and carry heat conducting wings that extend oppositely in the upstream and downstream direction of the flow of a coolant across the base. The wings are generally trapezoidal in shape, and they produce a greater drag on the coolant flow along the longer edge of the trapezoid shape than along the shorter edge. The pins along a column of coolant flow are oriented with the shorter parallel edges of the wings alternately at the base or at the top of the pin. The alternating regions of high drag and low drag produce an up-down motion in the coolant flow that improves heat transfer.

9 Claims, 5 Drawing Figures

COMPOSITE HEAT TRANSFER DEVICE WITH PINS HAVING WINGS ALTERNATELY ORIENTED FOR UP-DOWN FLOW

FIELD OF THE INVENTION

This invention relates to a device for transferring heat from a heat source such as a circuit component to a heat sink such as a stream of air.

More specifically, this invention is an improvement in the heat transfer device described in the publication "Heat Sink" by R. C. Chu and U. P. Hwang in the IBM Technical Disclosure Bulletin, Vol. 17 No. 12 May, 1975, pages 3656–3657.

INTRODUCTION

The heat transfer device of Chu and Hwang has a base and an array of heat conducting pins that are mounted in a row and column array on the base. A coolant such as chilled air is directed through the pins and heat is transferred from the pins to the coolant. In systems that will use either the device of this invention or the device of the Chu and Hwang publication, the coolant flows across the surface of the base in a direction that will arbitrarily be called the column direction. In the device of Chu and Hwang, the pins are given extended surface elements that will be called "wings". The wings extend at least generally in the direction of coolant flow and give the composite pin fins a more streamlined shape. Some heat transfer devices use pins without wings, and the pins are commonly called "pin fins". In this specification the term "pin" will mean the simple pin or post component and the term "composite pin fin" will mean the combination of a pin and wings.

This description will usually be easier to understand with examples in which the base is a relatively thin metal plate that is in thermal contact with a heat producing component. In these examples the base has a planar surface and a rectangular perimeter. However, these features are not significant to the invention, and the base can alternatively be formed by a heat producing component itself, the surface can be cylindrical or spherical or any other shape that is adaptable to supporting the pins, and the perimeter can have any desired shape. It will be convenient to visualize the device oriented with its base in a horizontal plane and with the pin supporting surface facing upward, but the device can be given any orientation. The general case will usually be apparent without specific reference to these alternatives.

In the device of Chu and Hwang the pins are cone shaped (the circular cross section of the cone is proportional to the heat flux) and the wings are shaped like parallelograms with two edges parallel to the side of the cone and two edges parallel to the base. Combining these parallelograms with the triangular cross section of the conical pin gives a trapezoidal shape to the pin and its wings when they are viewed along a row of the array.

SUMMARY OF THE INVENTION

An object of this invention is to provide a new and improved heat transfer device having composite pin fins that produce an up-down or corrugated flow in the coolant flowing across the base. This corrugated flow mixes the heated coolant close to the base with cooler fluid flowing higher above the base and thereby improves the heat transfer from the composite pin fins.

According to this invention, the wings are shaped to give an overall trapezoidal shape to a composite pin fin, and the composite pin fins are alternated along the column direction of coolant flow with one composite pin fin pointing up (as in Chu and Hwang) and the next composite pin fin pointing down. The pins are cylindrical or otherwise made with a uniform cross section so that the up or down orientation of a pin does not cause or produce any significant difference in the thermal or mechanical properties of the device. Stated somewhat differently, the wings have a thermal and fluid mechanical polarity but the pins do not have either of these polarities.

The surface of the wings produces an inherent drag on the flow of the coolant. Except for this drag, the coolant would, in a simplified analysis, generally flow evenly past the wings (but with some turbulence caused by the composite pin fins and by temperature differences in the fluid stream). The drag tends to slow the fluid, and the effect is cumulative along the horizontal length of the flow path. Thus, for a composite pin fin pointed up (like Chu and Hwang) the drag is greatest near the base and is least near the top. Conversely, for a composite pin fin pointing down the drag is greatest at the top and least near the base. Because the composite pin fins are pointed alternately up and down, the coolant stream encounters alternately higher and lower drag.

In a way that is somewhat analogous to the path of light through a prism, the lines of coolant flow tend to bend toward the horizontally narrower end of the trapezoidal wings after passing the upstream edge of the wing and while flowing alongside a composite pin fin and they tend to bend the other way after passing the downstream edge of the wing and while flowing in the gap between consecutive composite pin fins.

As an alternative explanation, the drag of the composite pin fins tends to make the fluid pile up and thereby tends to divert the fluid toward the short parallel side of the trapezoid.

Because the wings are alternated along the flow path, the flow is given a generally sinusoidal pattern, rising where the wings are pointed up and falling where the wings are pointed down. This up-down flow produces improved cooling.

Another object of the invention is to provide a composite pin fin device that is practical for manufacture and for use in cooling semiconductor circuit components. This feature of the invention will be illustrated by specific examples of pin and wing constructions.

THE DRAWING

THE PREFERRED EMBODIMENT

1. The Heat Transfer Device of FIG. 1

Figure 1:
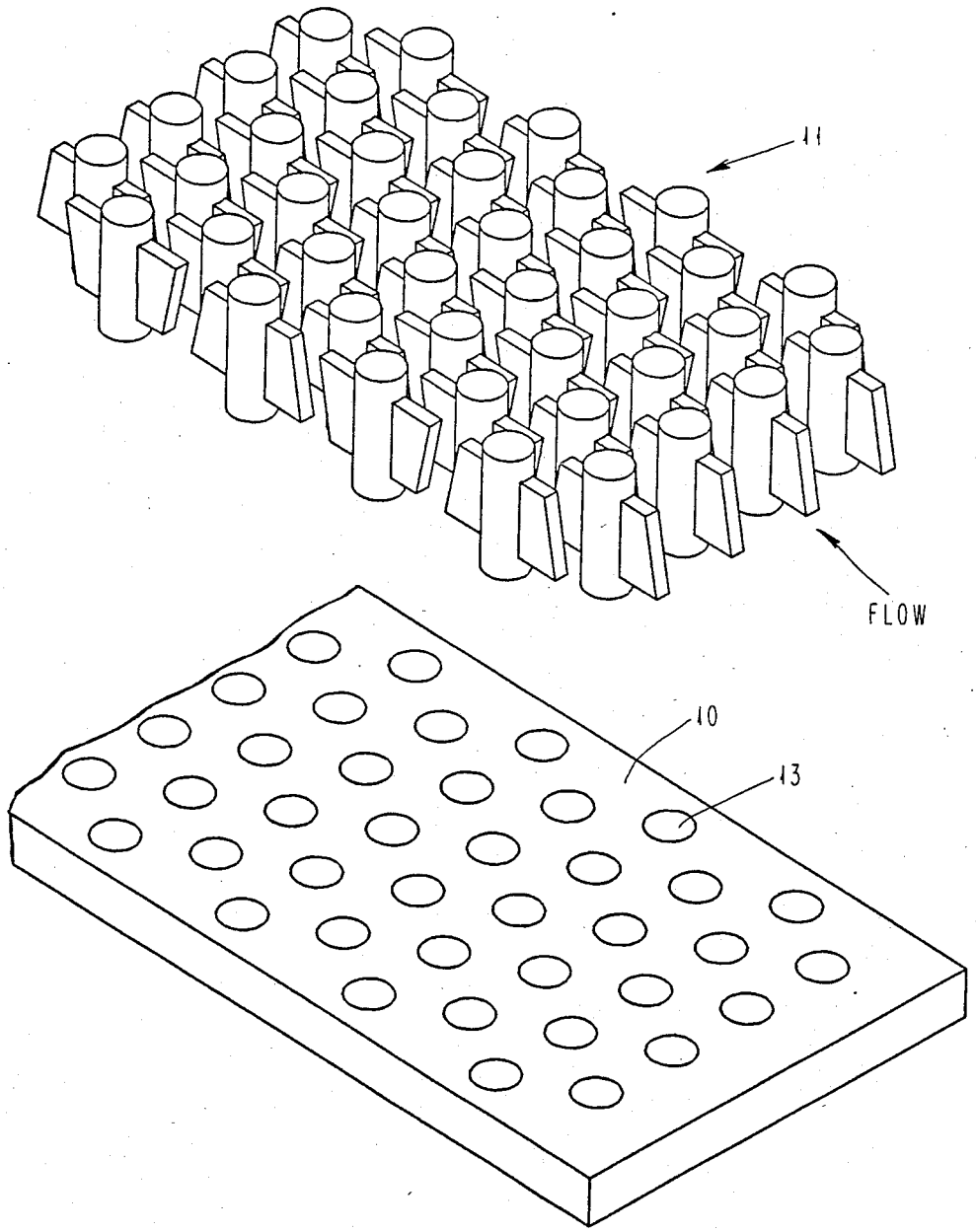
FIG. 1 is an isometric view of the base and composite pin fins of the heat transfer device of this invention.

FIG. 1 shows a base 10, composite pin fins 11 with the pins removed from the base. A composite pin fin has a pin 12 and wings 14 attached to the pin, and the base has holes 13 that receive the ends of the pins. The pins are mounted on the base in a row and column array. An arrow shows the direction of coolant flow along columns of the composite pin fins. A shroud 15, not shown in FIG. 1, is arranged to confine the fluid to flow through the composite pin fins. The shroud is spaced suitably above the tops of the composite pin fins so that heat transfer occurs from the upward facing surfaces of the composite pin fins.

The structure of FIG. 1 will be useful in many heat transfer applications, but will be helpful to introduce a cold plate as an example of a device using these composite pin fins. A semiconductor circuit package that is called a thermal conduction module (TCM) has a ceramic chip carrier that is mounted on a circuit board, chips mounted on the carrier, a metal hat structure mounted over the chip carrier, and a cold plate attached to the hat. The hat carries metal pistons that are held against the chips by springs and conduct heat from a chip to the hat. The cold plate that is a generally flat metal structure that has internal passages for chilled water. The passages are in the shape of a series of U turns between an inlet and an outlet. Heat is transferred to the water through the walls or the passages and through fins located in the passages. For this application the height of the composite pin fins is a few millimeters.

The physical structure of the composite pin fins will be discussed in section 4 and the arrangement of the composite pin fins on the base will be discussed in section 5.

2. The Effect of a Composite Pin Fin on Fluid Flow—FIG. 2

Figure 2:
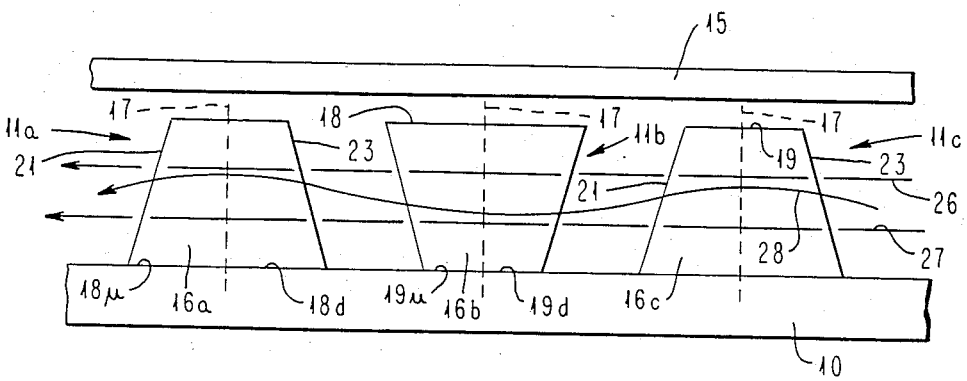
FIG. 2 is a side view of the heat transfer device with arrows showing the flow of a coolant along a column of composite pin fins.

FIG. 2 shows three composite pin fins 11*a*, 11*b*, 11*c* mounted along one column of base 10. FIG. 2 also shows shroud 15. The effect of the composite pin fin on the coolant flow will be described in terms of the general shape of the composite pin fins without regard to the physical structure of the pin and the wings, and the composite pin fins are shown in outline as trapezoids 16*a*, 16*b*, 16*c*. Preferably, as the drawing shows, the trapezoids are identical except that trapezoids 16*a* and 16*c* point up and trapezoid 16*b* points down. Each trapezoid is divided symmetrically by a dashed line 17 indicating the axis of the pin. Some reference characters have subscripts u and d to identify upstream and downstream elements that are otherwise identical, and the same reference character without a subscript will designate the elements either interchangeably or in combination. The terminology for the trapezoidal wings or the trapezoidal combination of a pin and its wings is similar to the terminology for a geometric trapezoid.

The wings have a longer parallel edge 18 and a shorter parallel edge 19 and two non-parallel edges 21 and 23. Since the wings are split symmetrically by the pin, each wing is also trapezoid. From a more general standpoint, the wings are wider in the direction of coolant flow near longer parallel edge 18 and are narrower in the direction of coolant flow near shorter parallel edge 19, and they have non- parallel edges 21 and 23 across the direction of fluid flow.

This general description of the wing shape includes for example a triangle and a half circle. The simple geometric trapezoid has advantages in manufacture as will be explained in the description of FIGS. 5 and 6, and it is preferred from the standpoint of the up-down flow. It also provides a large wing surface area for heat transfer, as will be apparent from the description of FIGS. 2 and 3.

The surface of a wing inherently produces a drag on the fluid stream. In FIG. 2, arrows 26 and 27 show a smooth flow past the wings and represent a simplified condition that would exist if this drag is not included in the analysis. The area between wings is an area of no drag in this analysis. Lines 26 and 27 are broken into segments to show where the lines of drag are equal or unequal in length.

Because the preferred composite pin fins are identical except for their orientation, lines 26 and 27 have equal lengths of contact along the surfaces of the wings over the span of a number of composite pin fins. Consequently they have substantially equal lengths of drag and no drag over a column of composite pin fins. It can be seen that one flow line 26 or 27 encounters low drag while the other flow line encounters high drag. The flow lines are bent from the areas of high drag toward the areas of low drag, and the resulting up-down flow is represented by a sinusoid 28.

3. The Relative Dimensions of the Composite Pin Fins—FIG. 3

Figure 3:
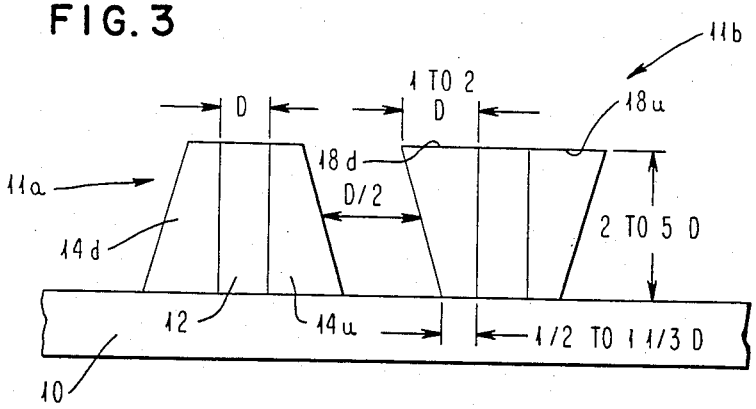
FIG. 3 is a view similar to FIG. 2 and shows the relative dimensions of the composite pin fin components.

FIG. 3 shows composite pin fins 11*a* and 11*b* with dimensions for the fins. For most applications the dimensions are in the range of dimensions that would be chosen for the conventional composite pin fin device of Chu and Hwang. The dimensions are in terms of the diameter of the pin which is designated "D". The long parallel edges 19*u*, 19*d* are each one to two diameters. The shorter parallel edge 18 (18*u*, 18*d*, plus the pin diameter) is between 2 to $3\frac{3}{8}$ diameters. Stated differently, the each short edge 18*u* or 18*d* is about $\frac{1}{2}$ to $\frac{3}{8}$ the horizontal width of the long edge 19*u* or 19*d*, not counting the pin width. The pins are shorter (about two diameters) for good heat transfer fluids such as water and are higher (about 5 diameters) for poorer heat transfer fluids such as fluorocarbons. Note that the range of values for the dimensions may be limited when one of these dimensions has been specified.

The preferred spacing between columns is about 3 to 4 diameters. The preferred spacing between rows is also about 3 to 4 diameters, but the row and column spacings are not necessarily the same.

4. Manufacturing the Pin Fins—FIGS. 4 and 5

Figure 4:
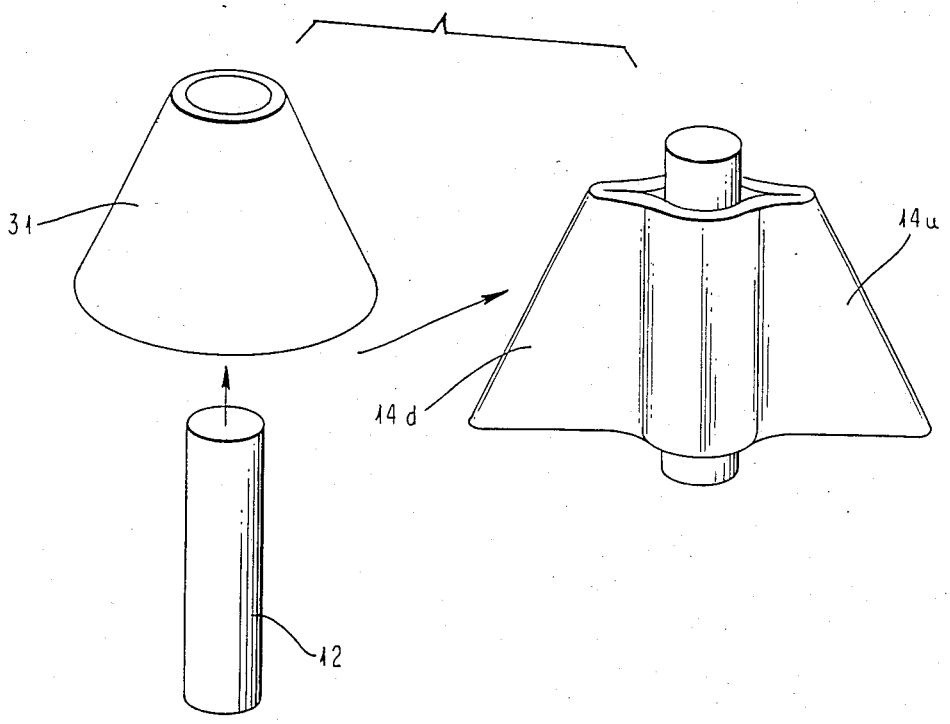
FIG. 4 is a perspective showing an assembled composite pin fin and separately showing a pin and a wing structure that is crimped to the pin to form the assembled composite pin fin.
Figure 5:
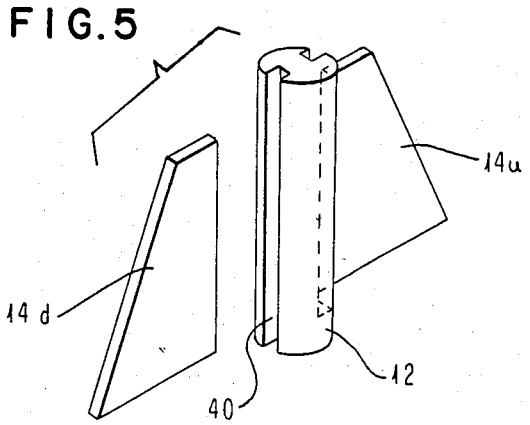
FIG. 5 is a perspective showing a pin and one wing soldered to the pin and the other wing in a disassembled position before being soldered to the pin.

The composite pin fin shown in FIG. 1 is formed as a unitary structure, preferably by a casting process. FIG. 4 shows a cone 31 of a thin metal that is crimped so as to grip pin 12 and to form wings 14*u* and 14*d*. FIG. 5. shows a pin 36 and wings 38, 39 that are assembled by soldering the wings in vertical grooves 40 in the pin. Note that the pins have portions 43, 44 that extend equally beyond the longer parallel edge 18 and the shorter parallel edge 19. In a preferred technique for attaching the pins to the base, the base has holes that receive these extending portions.

The fins can be tapered from the pin to the non parallel edges 21 and 23, as in Chu and Hwang, or they can have an essentially uniform thickness as in FIG. 1. The edges 21 and 23 can be rounded or they can be blunt as in FIG. 1.

5. Locating the Pins on the Base

The pins can be mounted on the base in any suitable pattern. The pattern of FIG. 1 is similar to FIG. 2 of the Chu and Hwang publication, where it is called a "staggered" arrangement. FIG. 2 of the Chu and Hwang publication shows an alternative "in-line" arrangement that can also be used with this invention. In the in-line arrangement, a composite pin fin is located at the intersection of each row and column. Other symmetrical patterns of composite pin fins will be apparent. Alternatively, the rows and columns can be given a non-uniform spacing.

In the examples so far, the parallel edges 18, 19 of the wings have been parallel to the columns of the pin locations, but in some applications it will be useful to turn the wings at a small angle to the column direction, up to about 35 degrees. For example, in an in-line arrangement of composite pin fins, the fins in one row can all be turned to the right and the pins in the next row turned to the left in a repeating pattern that produces a horizontally corrugated flow pattern.

Thus, from a more general standpoint the term "column" means a straight or curving line connecting pins that have their wings about parallel to this connecting line or within about thirty-five degrees of the line.

The pattern of pin spacing and the angle of the wings will be chosen to provide good heat transfer for a particular application. The location of the composite pin fins can be chosen to compensate for the effect that the coolant is heated as it flows through the fins. These factors can also be chosen to provide more or less cooling for different parts of the base, for example to provide more cooling near higher powered semiconductor chips and less cooling near lower powered semiconductor chips.

This feature of the invention is useful with the cold plate that was introduced earlier. There is a tendency for stagnant areas to develop in the water passages and for the temperature to rise in these areas. In one example, the wings of the composite pin fins are turned to follow the U shape at the ends of the channel segments to keep the water flowing throughout the channel. In another example the wings are turned to superimpose a horizontally corrugated flow on the U turn pattern.

7. Other Embodiments

The preferred composite pin fin has been described, and several examples have been given of the construction of the composite pin fin and applications for it in heat transfer devices. The heat transfer arts and the related metal working arts are well developed, and those skilled in the art will find many other application for the invention and will recognize suitable modifications within the intended scope of the claims.

What is claimed is:

1. A heat transfer device with improved composite pin fins, comprising, a base to be cooled or heated by a fluid directed across a surface of the base, pins of a heat conducting material mounted on the surface of the base in columns in the direction for fluid flow, wings attached to the pins and extending generally in the upstream and downstream directions of fluid flow, the wings in combination with the associated pin having a generally trapezoidal shape as viewed along the surface of the base at right angles to the direction of fluid flow, the trapezoid shape having a short parallel edge and a long parallel edge generally parallel to the base and having two non-parallel edges, the composite pin fins along the direction of fluid flow being oriented with the short parallel edges alternately near the edges of wings of consective composite pin fins being spaced apart, the pins being substantially uniform in cross section whereby the pin provides substantially the same heat transfer characteristics and impedance to the fluid flow in either orientation of the pin fin, whereby the fluid flow is retarded by the drag from the surface of the wings more near the long parallel edge of the wings than near the short parallel edge and consequently the fluid flow past the wings is deflected toward the short parallel edge and an up-down corrugated flow is produced for improved heat transfer.

2. The heat transfer device of claim 1 wherein the base is a separate component adapted to be mounted on a heat sink or heat source.

3. The heat transfer device of claim 1 wherein the width of the long edge of one upstream or downstream wing is about one to two pin diameters and the separation between nearby non-parallel edges of consecutive pin fins is about one half pin diameter.

4. The device of claim 1 wherein the pin is cylindrical and the wings are formed from a truncated conical element crimped to the pin.

5. The device of claim 1 wherein the pin is cylindrical and the wings are formed from trapezoidal elements soldered to the pin.

6. The device of claim 1 wherein the pin and its wings have a unitary structure formed by casting.

7. The device of claim 1 wherein the pins are mounted in equally spaced rows and equally spaced columns on the base, the columns being spaced apart by about two diameters of the pin.

8. The device of claim 6 wherein the wings are turned from the column direction by up to about 35 degrees, the wings in each row being turned in the same direction and the wings in consecutive rows being turned in opposite directions to produce a horizontally corrugated flow.

9. The device of claim 7 embodied in a cold plate for a circuit package, the cold plate having internal passages for chilled water from an inlet to an outlet, the composite pin fins being few millimeters high and being arrayed in the internal passages.

* * * * *